US005448839A

United States Patent [19]

Blissett et al.

[11] Patent Number: 5,448,839

[45] Date of Patent: Sep. 12, 1995

[54] STAND EASY SHOE

[75] Inventors: Malcolm G. Blissett, Grand Haven; Raymond M. Fredericksen, East Lansing, both of Mich.

[73] Assignee: Wolverine World Wide, Inc., Rockford, Mich.

[21] Appl. No.: 143,915

[22] Filed: Oct. 27, 1993

[51] Int. Cl.[6] ..... A43B 13/00; A43B 13/04

[52] U.S. Cl. ..... 36/25 R; 36/28; 36/59 C; 36/88; 36/103; 36/144

[58] Field of Search ..... 36/25 R, 28, 32 R, 59 C, 36/88, 114, 103, 143, 144

[56] References Cited

U.S. PATENT DOCUMENTS

| | | | |
|---|---|---|---|
| D. 30,641 | 4/1899 | Peters . | |
| D. 267,366 | 12/1982 | Davis | D2/320 |
| 1,958,097 | 5/1934 | Shaw | 36/144 |
| 2,160,991 | 6/1939 | Schwartz | 36/144 |
| 2,616,190 | 11/1952 | Darby | 36/144 |
| 3,267,592 | 8/1966 | Champion | 36/35 R |
| 3,550,597 | 12/1970 | Coplans | 36/144 |
| 3,990,159 | 11/1976 | Borgeas | 36/28 |
| 4,041,619 | 8/1977 | Sapper | 36/103 |
| 4,557,059 | 12/1985 | Misevich et al. | 36/25 R |
| 4,578,882 | 4/1986 | Talarico, II | 36/103 |
| 4,620,376 | 11/1986 | Talarico, II | 36/103 |
| 4,624,062 | 11/1986 | Autry | 36/28 |
| 4,642,911 | 2/1987 | Talarico, II | 36/30 |

*Primary Examiner*—Steven N. Meyers
*Assistant Examiner*—Marie D. Patterson
*Attorney, Agent, or Firm*—Price, Heneveld, Cooper, DeWitt & Litton

[57] ABSTRACT

A shoe and polymeric shoe sole having a heel portion slanted upwardly at a small acute angle from the medial side to the lateral side relative to the horizontal support surface, a forefoot portion slanted upwardly at a small acute angle from the lateral side to the medial side relative to the support surface, and a diagonally crossing neutral zone in the midfoot portion. The heel portion has a central, resilient, compressible, calcaneal pad which is substantially unslanted, preferably with a downward, slightly convex configuration. The calcaneal pad protrudes downwardly below the slanted bottom surface at the lateral side of the heel portion and is recessed upwardly above the slanted bottom surface at the medial side of the heel portion. The metatarsal head pad extends downwardly below the slanted bottom surface at the medial side of the forefoot portion and is recessed above the slanted bottom surface at the lateral side of the forefoot portion. The lateral side of the forefoot portion and the medial side of the heel portion together form an S-curve which crosses the sole at the midfoot portion.

13 Claims, 7 Drawing Sheets

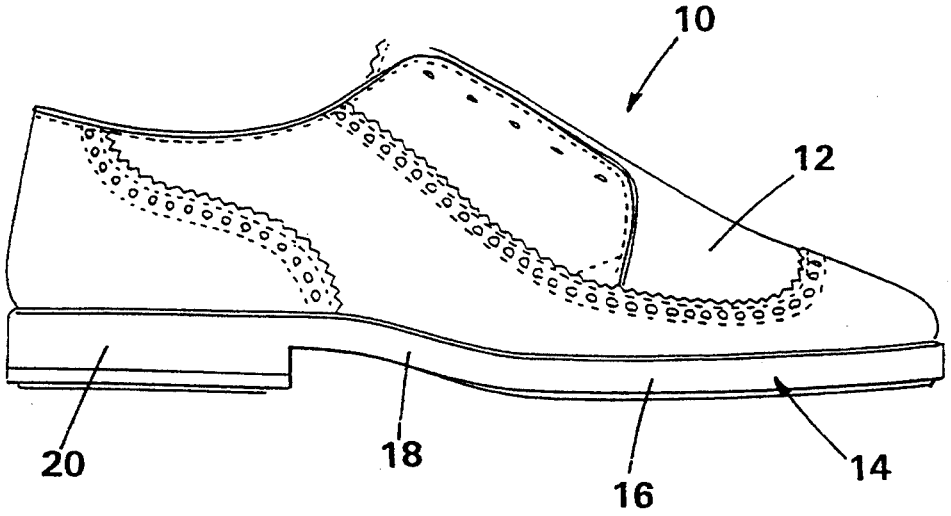
FIG. 10
FIG. 11A
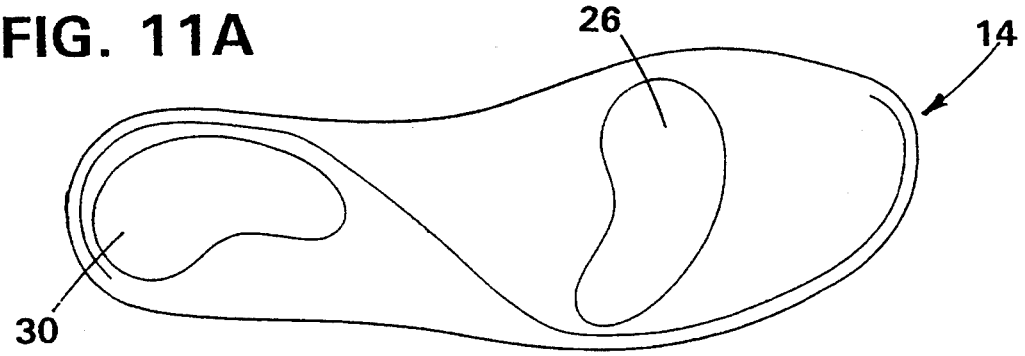
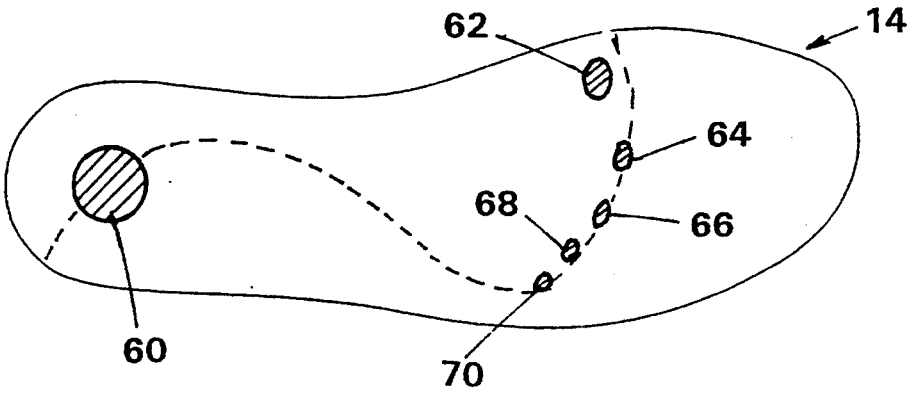
FIG. 11B

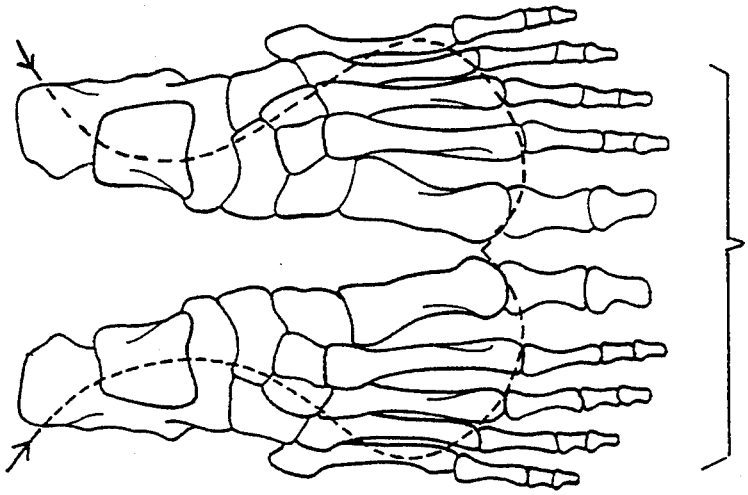
FIG. 12
FIG. 13
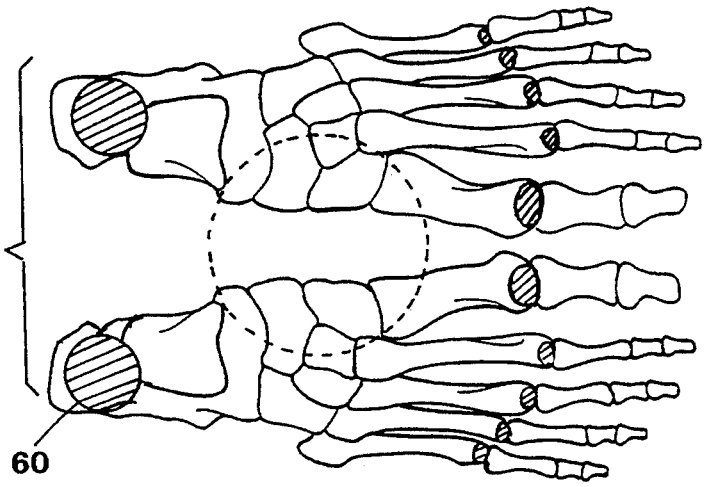
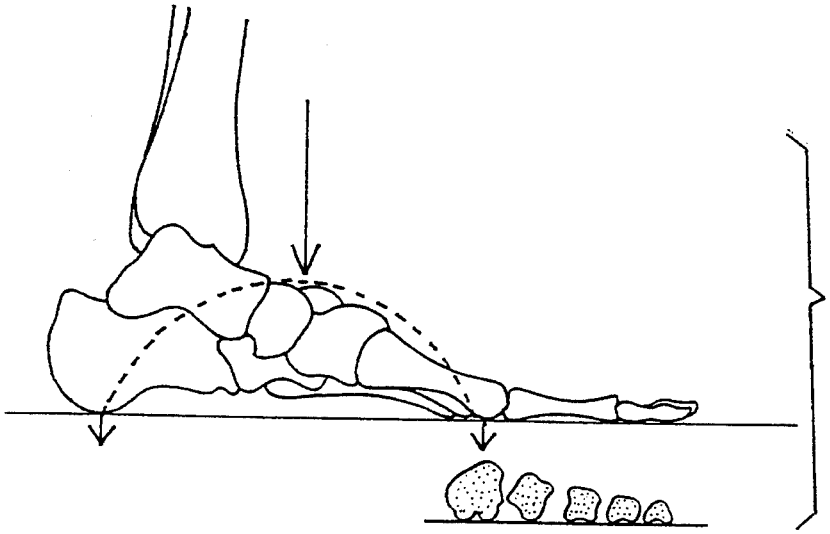
FIG. 14

STAND EASY SHOE

BACKGROUND OF THE INVENTION

This invention relates to shoes and shoe soles, and particularly to shoe soles for persons who experience prolonged periods of standing.

In recent decades, tremendous efforts and cost have been put forth for research into the complex action of the human foot during various types of activity, and into the engineering and design of footwear to maximize benefits to the wearer during these activities. Specifically, extensive research has been conducted for activities including basketball, aerobics, running, jogging and football, as well as desired characteristics of footwear for these activities. Even the activity of walking and the design of walking shoes has been explored relative to the complex foot action involved, but to a lesser extent. Moreover, substantial efforts have been made relative to the function and design of work boots relative to foot action.

One area of human activity which is not believed to have received the attention it deserves is that of standing. The nature and function of the complex human foot, and the effects on the leg and body during standing, is also complicated. As is known by anyone who has had an occupation or activity involving long periods of standing, e.g., store clerks, factory workers, cashiers, theater personnel, or even persons who have had to wait in long lines such as at amusement parks, theaters, etc., standing can cause particular foot and leg fatigue and stress, even stress to the spinal area.

The foot is comprised of about 25 percent of all of the bones in the human body. The foot functions to support the weight of the body and to absorb shock and propel it forward during human movement. During standing, the arch of the foot functions much like the truss of a suspension bridge, the muscle/tendon junctions of the lower leg functioning to support the arch of the foot.

The strongest structure of the foot while standing is a high arched or neutral position. In this position, proper biomechanical posture and balance are maintained. When the arch of the foot collapses, greater stress is applied to the muscle/tendon junctions causing fatigue or even injury. Comfort while standing is correlated to balance and posture of the human body. When the muscles of the lower leg and foot begin to fatigue after extended periods of standing, people tend to become restless. They continually shift their body weight from leg to leg and flex their knees to alleviate concentrated stress to muscles and tendons.

SUMMARY OF THE INVENTION

An object of this invention is to provide a special shoe and shoe sole structure having superior comfort during standing, particularly standing for extended periods of time. Experimental testing of the novel shoe and sole by representative personnel has evoked considerable comments of satisfaction and praise.

The novel resilient polymeric shoe sole has a heel portion which, under load, is slanted upwardly at a small acute angle from the lateral side to the medial side relative to the horizontal support surface, a forefoot portion which, under load, is slanted downwardly at a small acute angle from the lateral side to the medial side relative to the support surface, and a diagonally crossing neutral zone in the midfoot portion. The shoe sole effects a varus wedge of about 3°-5° to the horizontal at the heel, i.e., rearfoot portion, and a valgus wedge of about 3°-5° to the horizontal at the forefoot. The heel portion has a central, resilient, compressible, calcaneal pad which is substantially unslanted, preferably with a downward, slightly convex configuration. The bottom surface thereof is substantially parallel to the upper heel support surface 21, i.e., at a low angle convex curvature from side to side. This pad can be of a more resilient material than the rest of the sole. The forefoot portion has a central, resilient, compressible, metatarsal head pad which is substantially unslanted and preferably has a downward, slightly convex configuration. The bottom surface is substantially parallel to the upper forefoot support surface 27, i.e., at a low angle convex curvature from side to side. The metatarsal head pad can be of a more resilient material also. The calcaneal pad preferably protrudes downwardly below the slanted bottom surface at the lateral side of the heel portion and is recessed upwardly above the slanted bottom surface at the medial side of the heel portion. The metatarsal head pad preferably extends downwardly below the slanted bottom surface at the medial side of the forefoot portion and is recessed above the slanted bottom surface at the lateral side of the forefoot portion. The lateral side of the forefoot portion and the medial side of the heel portion together generally form an S-curve which crosses the sole at the midfoot portion. The novel shoe soles create a varus wedge of about 3°-5° at the forefoot. The novel soles tend to unlock the knees when standing, creating a more comfortable stance.

These and other objects, advantages and features of the invention will be apparent from a review of the following specification in conjunction with the drawings.

BRIEF DESCRIPTION OF THE DRAWINGS

FIG. 10 is a side elevational view of a dress shoe employing another embodiment of the novel shoe sole;

FIG. 11A is a simplified bottom plan outline view of the shoe sole in FIGS. 1-8;

FIG. 11B is a plan view of a shoe sole showing the main contact points of a foot when standing;

FIG. 12 is a plan view of the bones in a pair of human feet showing the path of travel of the force on the feet and the ground surface when bodily weight is shifted forwardly;

FIG. 13 is a plan view of the bones of a pair of human feet showing the points of contact of the feet to the ground surface when standing;

FIG. 14 is a side elevational view of the bones of a human foot, shown from the medial side, showing the arch relationship with the points of applied force between the foot and the support surface;

DESCRIPTION OF THE PREFERRED EMBODIMENT

Figure 7:
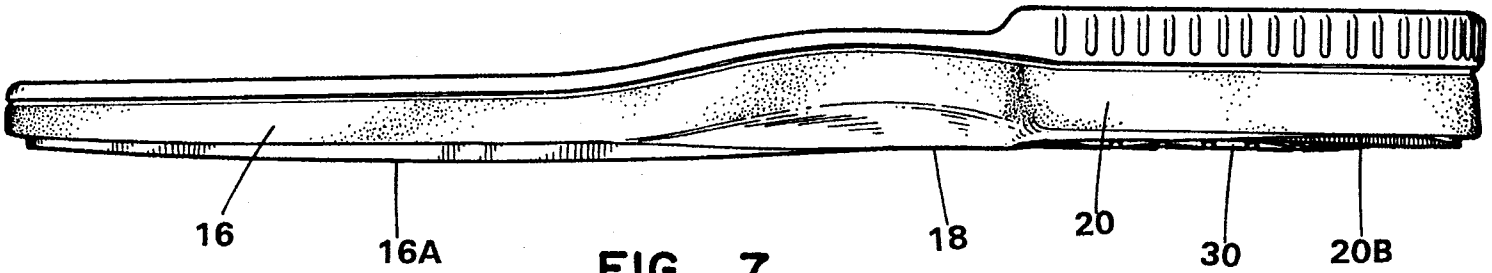
FIG. 7 is an elevational view of the medial side of the shoe sole.
Figure 8:
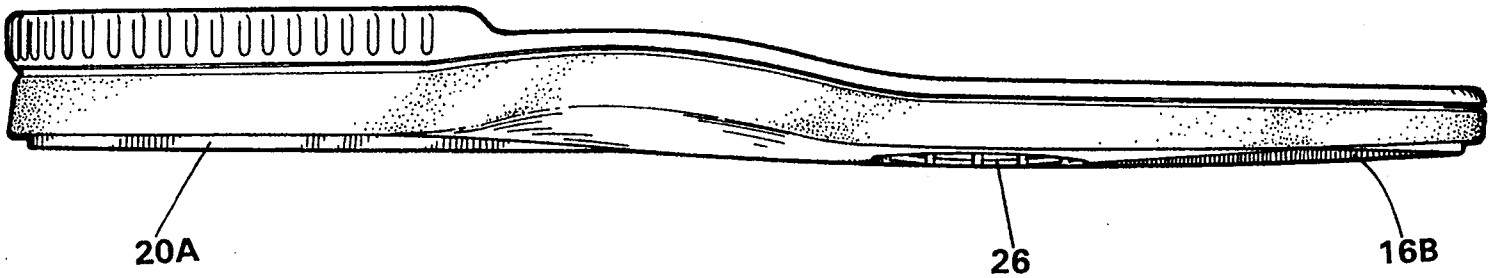
FIG. 8 is an elevational view of the lateral side of the shoe sole.

Referring now specifically to the drawings, a shoe includes an upper and a sole subassembly 14. This sole subassembly is shown to include a forefoot portion 16, a midfoot portion 18, and a heel portion 20 (FIG. 7). The particular style of shoe and pattern to be applied to the upper can vary widely, as will be apparent to those in the art upon studying this disclosure. Likewise, the means for fastening the shoe to the foot, whether laces, Velcro ® brand hook and loop fasteners, elastic bands, or the like, can be used. The details of the shoe sole subassembly 14 as for a casual type shoe are shown more specifically in FIGS. 1–8.

Figure 4:
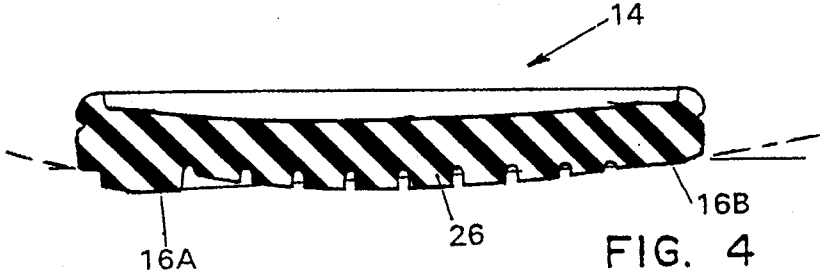
FIG. 4 is a sectional view taken on plane IV—IV of FIG. 1 with the sole not under load.

The character of the shoe sole at the bottom thereof changes in a particular manner from the forefoot portion through the midfoot portion to the heel portion. Specifically, the undersurface of the sole in the forefoot portion, under load, slopes upwardly, relative to the horizontal support surface, from the medial side to the lateral side, at a small acute angle, preferably around 3°–5° i.e., a valgus wedge. In the form of the sole bottom depicted in FIG. 1, this sloped area can have a plurality of parallel indentation stripes 24 transverse to the longitudinal axis of the shoe. This is simply one example, since the particular surface pattern on this sloped surface can vary significantly from one type of shoe or style of shoe to another. This sloped area preferably has a downward, very slight convex curvature from side to side of the sole (FIG. 4). The forefoot portion overall is basically parallel to the upper foot support surface of the sole which has a low angle concave curvature from side to side, such that the outer bottom forefoot sole portion has a low angle, convex curvature from side to side (see phantom lines in FIGS. 4 and 6). Stated differently, the loaded forefoot sole portion lateral side is raised above the floor about one-eighth inch and curves slopingly down to the floor at the medial side. In the central part of the forefoot portion of the shoe is a metatarsal pad 26 which is shown to have a preferred teardrop-type configuration from the medial side **16*a* to the lateral side 16*b*, the larger portion being at the medial side to be beneath the larger metatarsal heads of the human foot. This metatarsal pad is resilient and compressible, having a substantially or generally unslanted character from one side to the other, preferably with a downward, slightly convex configuration. The bottom surface of this pad is generally parallel to the top, forefoot support surface 27**.

Figure 2:
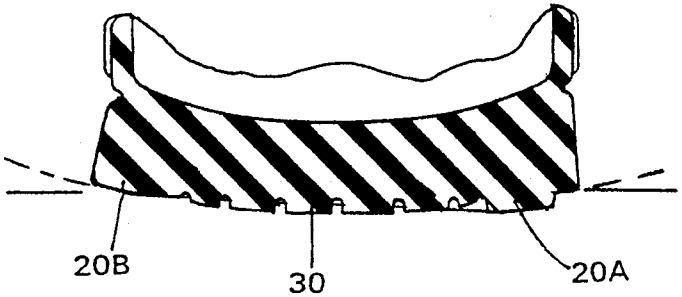
FIG. 2 is a sectional view taken on plane II—II of FIG. 1 with the sole not under load.
Figure 5A:
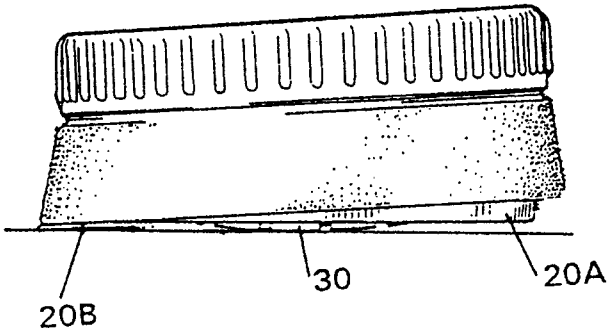
FIG. 5A is a rear elevational view of the shoe sole with the sole under load.
Figure 6A:
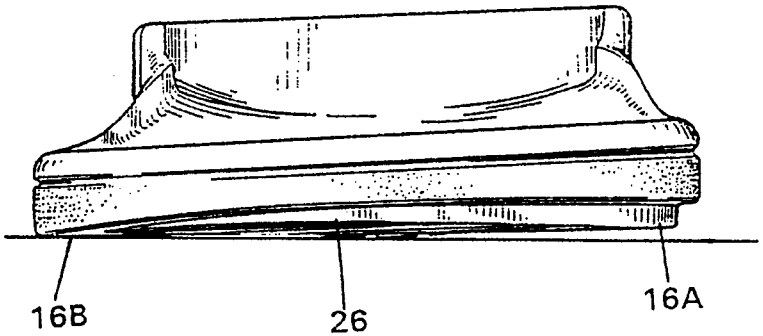
FIG. 6A is a front elevational view of the shoe sole with the sole under load.
Figure 4A:
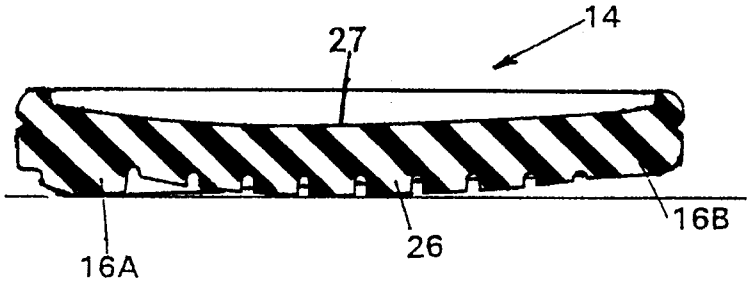
FIG. 4A is a sectional view taken on plane IV—IV of FIG. 1 with the sold under load.
Figure 2A:
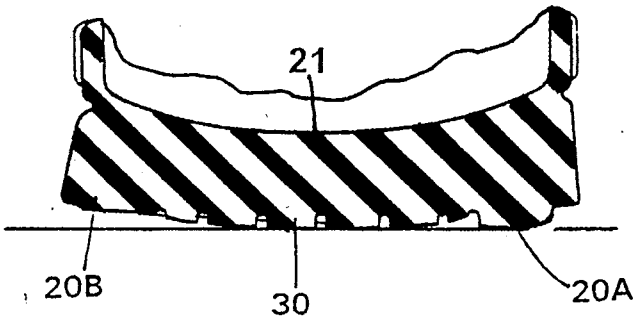
FIG. 2A is a sectional view taken on plane II—II of FIG. 1 with the sole under load.

The heel portion of the shoe has a contrary slope relative to the forefoot portion, i.e., being slanted or sloped relative to the horizontal support surface opposite to that of the forefoot portion, i.e., upwardly from the lateral side **20*b* to the medial side 20*a*, at a small acute angle, preferably of about 3°–5° i.e. varus wedge. This sloped area preferably has a downward, slightly convex curvature from side to side of the sole (FIG. 2). Stated differently, the heel portion medial side is raised above the floor about one-eighth inch and curves slopingly down to the floor at the lateral side. In the central part of the heel portion is a calcaneal pad 30 which is positioned under the calcaneum bone of the heel of the human foot. This pad in this embodiment is shown to be slightly teardrop-shaped, with the larger area at the rear and the smaller area at the front thereof. Alternatively, this could have another configuration such as a circle. This calcaneal pad is generally or substantially unslanted, so that it does not slope from one side to the other, but it preferably also has a downward, slightly convex configuration. The bottom surface of pad 30 is generally parallel to the top, heel support surface 21. The heel portion bottom surface around the calcaneal pad is also shown to have transverse lateral grooves 32. Here again, as with the forefoot portion, this rear foot surface can vary from shoe style to shoe style. The heel portion is basically parallel to the concave, curved, upper foot support surface, from side to side, so as to be convexly curved at a low angle from side to side (see phantom lines in FIGS. 2 and 5**).

Figure 3:
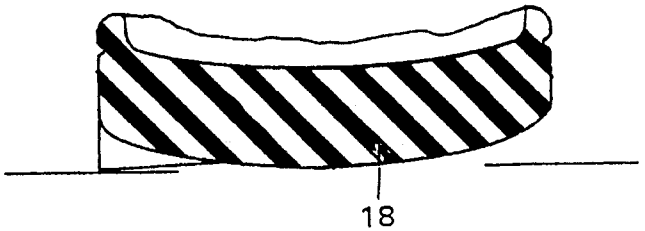
FIG. 3 is a sectional view taken on plane III—III of FIG. 1 with the sole not under load.

The midfoot portion 18 of the sole is basically symmetrical, not really having a slant bias in either direction. It is shown in FIG. 3 to have a downward, slightly convex configuration.

In the more casual shoe sole shown in FIGS. 1–9, the sole with its sloped characteristics defines a generally S-curve or reverse S-curve 40, depending upon whether it is the fight foot or left foot, from the heel portion to the toe zone. This S-curve, shown in the form of a reverse S-curve in FIG. 1 at 40, curves around the rear of the heel, along the medial side of the heel or rear foot portion, crossing over the longitudinal centerline of the shoe sole in the midfoot portion, and then continuing around the lateral edge of the forefoot portion and around the edge of the toe zone of the shoe sole. The crossover point at the midfoot portion of an average length shoe is about the length of the shoe divided by about 2.4.

Figure 9:
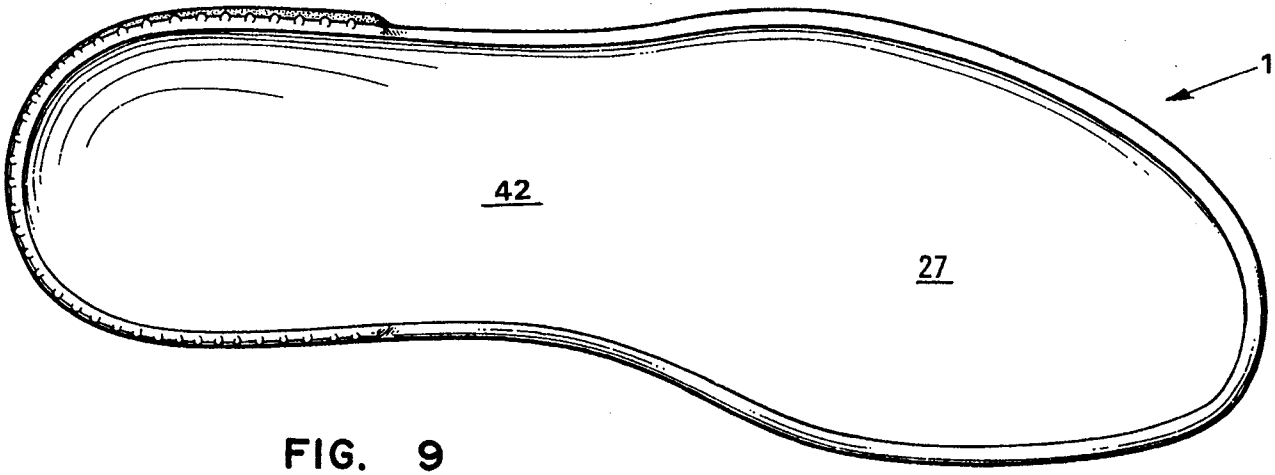
FIG. 9 is a top view of the shoe sole.
Figure 1:
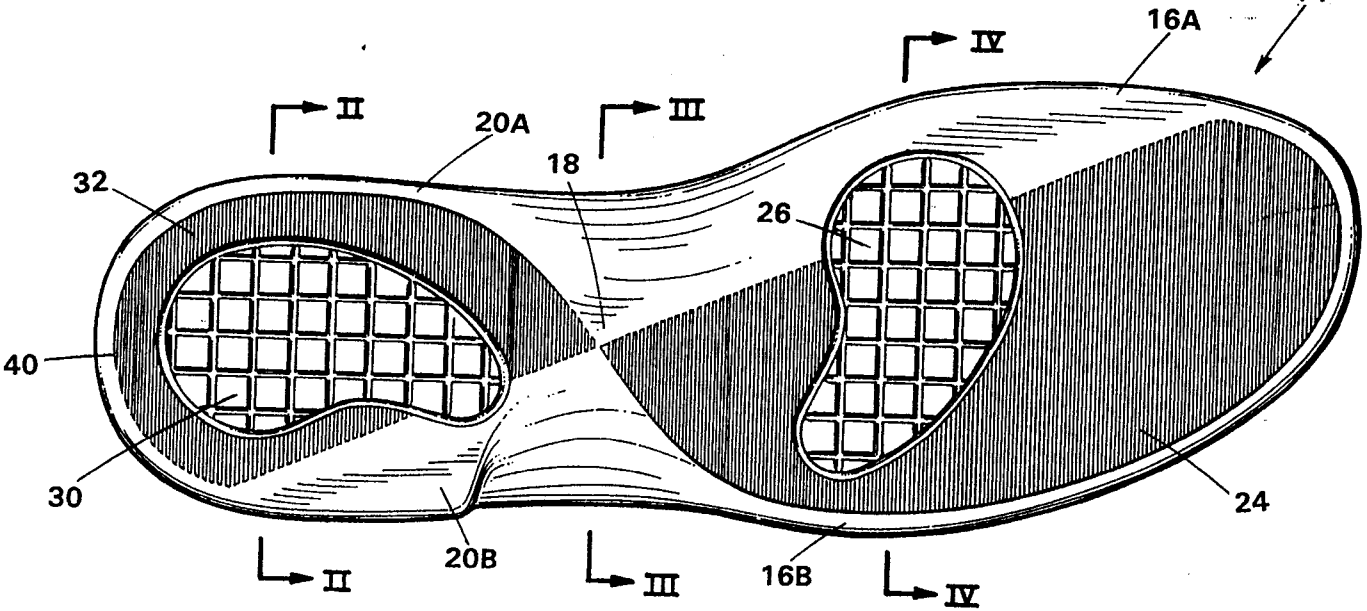
FIG. 1 is a bottom view of the novel shoe sole.
Figure 5:
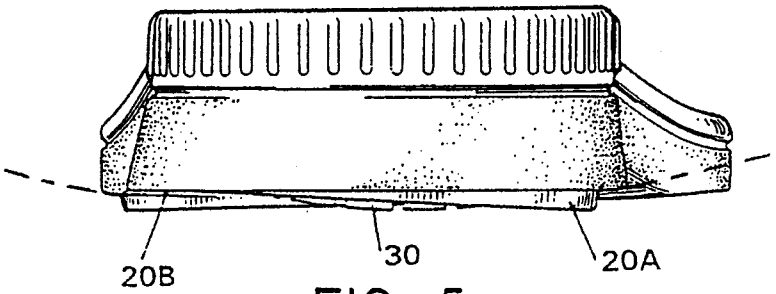
FIG. 5 is a rear elevational view of the shoe sole with the sold not under load.
Figure 6:
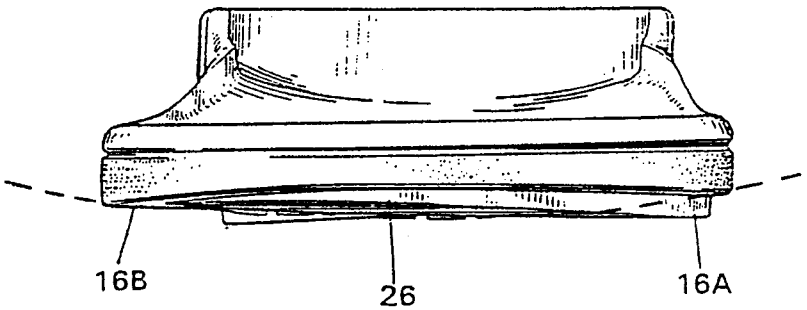
FIG. 6 is a front elevational view of the shoe sole with the sole not under load.

The top of the shoe sole, as shown in FIG. 9, is of conventional type, to receive and be attached to the shoe upper and provide a foot support insole surface 42 of which area 21 and 27 form a part. FIG. 11B shows the points of force applied by the calcaneum and by the metatarsal heads of a human foot, as well as the pattern of the force application when the body weight is rocked back and forth between the rear foot and forefoot portions. Specifically, the central circle 60 in the heel shows where the calcaneum applies its force, while the smaller circles at 62, 64, 66, 68 and 70 show where the five metatarsal heads apply force in the forepart of the shoe. The specific heel bones and metatarsal bones, along with the metatarsal heads, are illustrated with the force lines in FIG. 12. Applying the force points 60–70 of FIG. 11B to the skeletal foot structure in FIG. 12 gives the composite of FIG. 13 where these force points are shown applied by the calcaneum and the five metatarsal heads. The foot structure supporting this weight is depicted as the natural arch in FIG. 14, with the five metatarsal heads being set forth therebelow.

The unique sole can take slightly different forms, depending on the style of shoe involved. FIG. 10 depicts a dress shoe 10 with an "outside heel," as compared to the inside heel structure of FIGS. 1–8. The heel portion 20', midfoot portion 18' and forefoot portion 16' compose the sole subassembly 14' to which the upper 12 is attached. The heel portion and forefoot portion are sloped as noted relative to the first embodiment in FIGS. 1–8, although the S curve formed is interrupted briefly in the midfoot portion.

Figure 15:
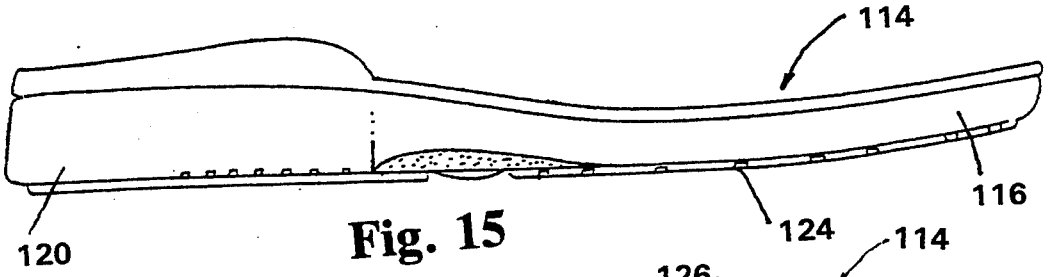
FIG. 15 is a side elevational view of the lateral side of a third embodiment of the novel shoe sole.
Figure 16:
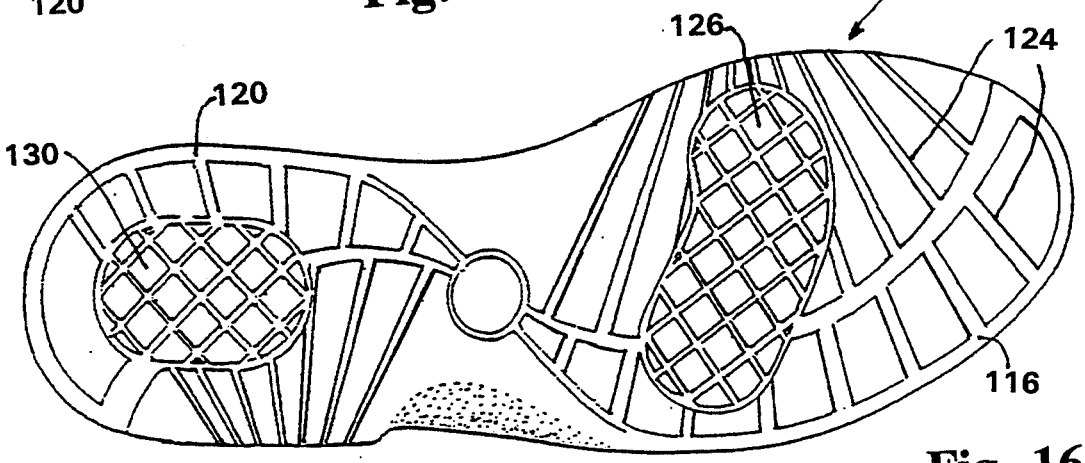
FIG. 16 is a bottom plan view of the sole in FIG. 15.

In FIGS. 15 and 16 is shown a modified version of a casual shoe sole 114 with a different sole surface pattern. Specifically, on the forefoot portion 116 there are surface grooves 124 which radiate out from the medial side toward the lateral side. The metatarsal pad 126 is rather peanut-shaped. The forefoot portion 116 slopes vertically in the manner described relative to the FIGS. 1–8 embodiment. Heel portion 120 has surface grooves 132 which radiate out from the lateral side toward the medial side. The heel portion 120 is sloped like that described relative to the embodiment in FIGS. 1–8. The calcaneal pad 130 is shown to be oval-shaped. The sloping surfaces define an S-curve 140 extending around the medial side of the heel portion 120, across the centerline of the shoe at the midfoot portion 118, around the lateral side of the forefoot portion 116, and across the toe zone. The crossover zone in the midfoot region is shown as a circle.

Figure 18:
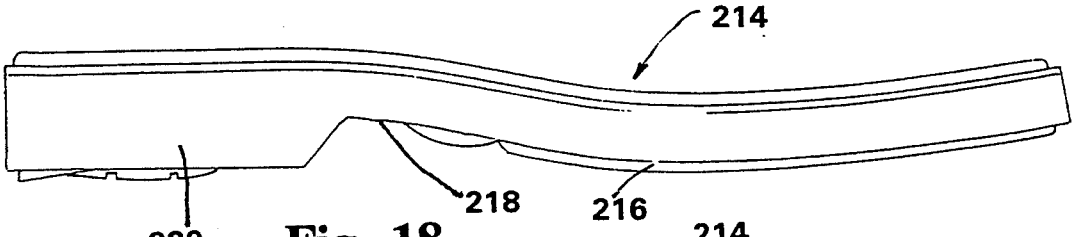
FIG. 18 is a side elevational view of the lateral side of the sole in FIG. 17.
Figure 17:
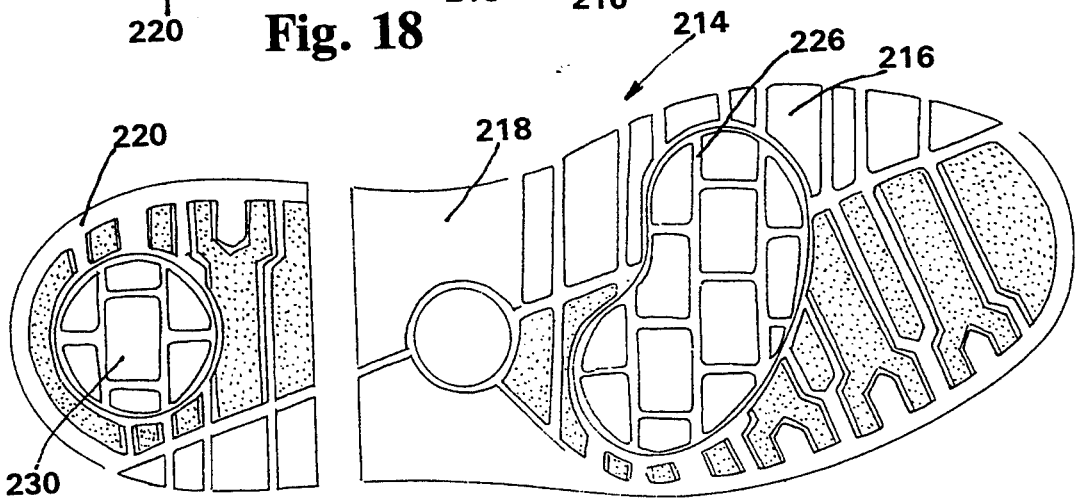
FIG. 17 is a bottom plan view of a work boot sole forming the fourth embodiment of this invention.

In FIGS. 17 and 18 is shown a sole 2 14 for a work boot. The work boot sole has an outside heel at the heel portion 220, an upwardly arched midfoot portion 218, and a forefoot portion 216. The forefoot portion is sloped like that described for the embodiment at FIGS. 1–8, and the heel portion is also sloped like that described for the embodiment at FIGS. 1–8. The metatarsal pad 226 is shown to be kidney bean-shaped. The calcaneal pad 230 is shown to be circular. The S-curve has an interruption at the midfoot portion.

The novel shoe, and particularly the novel shoe sole, specially accommodates the force structure applied by a person during standing, such that prolonged periods of standing produce significantly less fatigue than with conventional shoe structures. Applicant does not have a complete understanding of all foot characteristics of the complex foot structure which render the novel structure less fatiguing than conventional structures. As has been generally illustrated, shoes using the unique structure may vary considerably to suit particular styles or general classes of shoes, without departing from the scope of the invention. It is intended that the invention be limited only by the scope of the appended claims and the reasonably equivalent structures to those defined therein.

The embodiments of the invention in which an exclusive property or privilege is claimed are defined as follows.

1. A shoe sole for prolonged standing, comprising:

a polymeric shoe sole having a heel portion, a midfoot portion, and a forefoot portion;

said heel portion, under load, having a bottom surface slanted upwardly at a small acute angle from the lateral side of said heel portion to the medial side of said heel portion, and having a central, resilient, compressible, calcaneal pad substantially unslanted;

said forefoot portion, under load, having a bottom surface slanted upwardly at a small acute angle from the medial side of said forefoot portion to the lateral side of said forefoot portion to be slanted opposite that of said heel portion, and having a central, resilient, compressible metatarsal head pad substantially unslanted;

said calcaneal pad protruding downwardly below said medial side of said heel portion and being recessed upwardly above said lateral side of said heel portion.

2. The shoe sole in claim 1 wherein said calcaneal pad is slightly convexly downwardly curved from side to side.

3. The shoe sole in claim 1 including an upper slightly concavely curved heel support surface generally parallel to a bottom convexly curved surface of said heel portion, and including an upper slightly concavely curved forefoot support surface generally parallel to a bottom concavely curved surface of said forefoot portion.

4. The shoe sole in claim 1 wherein said heel portion is slanted at an angle of about 3°–5° from the horizontal.

5. The shoe sole in claim 4 wherein said forefoot portion is slanted at an angle of about 3°–5° from the horizontal.

6. A shoe sole for prolonged standing, comprising:

a polymeric shoe Sole having a heel portion, a midfoot portion, and a forefoot portion;

said heel portion, under load, having a bottom surface slanted upwardly at a small acute angle from the lateral Side of said heel portion to the medial side of said heel portion, and having a central, resilient, compressible, calcaneal pad substantially unslanted;

said forefoot portion, under .load, having a bottom surface slanted upwardly at a small acute angle from the medial side of said forefoot portion to the lateral side of said forefoot portion to be slanted opposite that of said heel portion, and having a central, resilient, compressible metatarsal head pad substantially unslanted;

said metatarsal head pad extending downwardly below said lateral side of said forefoot portion and being recessed upwardly above said medial side of said forefoot portion.

7. The shoe sole in claim 6 wherein said metatarsal head pad is slightly convexly downwardly curved from side to side.

8. A shoe sole for prolonged standing, comprising:

a polymeric shoe sole having a heel portion, a midfoot portion, and a forefoot portion;

said heel portion, under load, having a bottom surface slanted upwardly at a small acute angle from the lateral side of said heel portion to the medial side of said heel portion, and having a central, resilient, compressible, calcaneal pad substantially unslanted; and said forefoot portion, under load, having a bottom surface slanted upwardly at a small acute angle from the medial side of said forefoot portion to the lateral side of said forefoot portion to be slanted opposite that of said heel portion;

said calcaneal pad protruding downwardly below said medial side of said heel portion and being recessed upwardly above said lateral side of said heel portion.

9. The shoe sole in claim 8 wherein said calcaneal pad is slightly convexly downwardly curved from side to side.

10. The shoe sole in claim 8 wherein the lateral side of said forefoot portion and the medial side of said heel portion form an S-curve which crosses said sole at said midfoot portion.

11. A shoe sole for prolonged standing, comprising:

a polymeric shoe sole having a heel portion, a midfoot portion, and a forefoot portion;

said heel portion, under load, having a bottom surface slanted upwardly at a small acute angle from the lateral side of said heel portion to the medial side of said heel portion:

said forefoot portion, under load, having a bottom surface slanted upwardly at a small acute angle from the me, dial side of said forefoot portion to the lateral side of said forefoot portion to be slanted opposite that of said heel portion, and having a central, resilient, compressible metatarsal head pad substantially unslanted;

said metatarsal head pad protruding downwardly below said lateral side of said forefoot portion and being recessed upwardly above said medial side of said forefoot portion.

12. The shoe sole in claim 11 wherein said metatarsal head pad is slightly convexly downwardly curved from side to side.

13. The shoe sole in claim 11 wherein the lateral side of said forefoot portion and the medial side of said heel portion form an S-curve which crosses said sole at said midfoot portion.

* * * * *

UNITED STATES PATENT AND TRADEMARK OFFICE

CERTIFICATE OF CORRECTION

PATENT NO. : 5,448,839
DATED : September 12, 1995
INVENTOR(S) : Malcolm G. Blissett et al.

It is certified that error appears in the above-indentified patent and that said Letters Patent is hereby corrected as shown below:

Column 4, line 38:
"fight foot" should be –right foot–.

Column 5, line 31:
"sole 2 14" should be –sole 214–.

Claims
Column 6, line 28, claim 6:
"Sole" should be –sole–.

Column 6, line 32, claim 6:
"Side" should be –side–.

Column 6, line 36, claim 6:
Before "load" delete –.–.

Column 7, line 17, claim 11:
"me, dial" should be –medial–.

Signed and Sealed this

Eighteenth Day of June, 1996

Bruce Lehman

*Attest:*

BRUCE LEHMAN

*Attesting Officer*

*Commissioner of Patents and Trademarks*